United States Patent [19]

Niedzielski

[11] 3,970,574

[45] July 20, 1976

[54] HYDRAULIC BRAKE FLUID COMPOSITION

[75] Inventor: Edmund Luke Niedzielski, Wilmington, Del.

[73] Assignee: E. I. Du Pont De Nemours & Co., Wilmington, Del.

[22] Filed: June 16, 1975

[21] Appl. No.: 587,226

[52] U.S. Cl. ..... 252/79

[51] Int. Cl.[2] ..... C10M 3/20; C09K 3/00

[58] Field of Search ..... 252/79

[56] References Cited

UNITED STATES PATENTS 3,003,968 10/1961 Bruce et al. ..... 252/79

3,825,497 7/1974 Ker ..... 252/79

*Primary Examiner*—Harris A. Pitlick

[57] ABSTRACT

A random equilibrium mixture of triethylene glycol diesters of acetic and propionic acids, wherein the molar ratio of acetyl to propionyl groups in the mixed ester composition is from about 40:60 to 50:50, is useful as a hydraulic brake fluid. The composition shows no increase in low temperature (−40°C.) viscosity in the presence of up to 6% by weight of water.

7 Claims, No Drawings

HYDRAULIC BRAKE FLUID COMPOSITION

FIELD OF INVENTION

The present invention concerns hydraulic fluid compositions.

BACKGROUND OF THE INVENTION

Hydraulic fluids used in automotive hydraulic brake systems must satisfy a variety of requirements. In general, these include chemical and thermal stability, suitable viscosities for the intended use, fluidity over the use-temperature range, low volatility, non-corrosiveness to metals, limited effect on rubber parts and good tolerance for water. Thus, a hydraulic brake fluid to be commercially acceptable is required to meet industry-accepted specifications as well as those established by governmental agencies. Industrial specifications include Society of Automotive Engineers (SAE) specifications such as 7Or1 Artic and 7Or3. Governmental specifications include National Highway Traffic Safety Administration, Department of Transportation, Federal Motor Vehicle Safety Standard 571.116 and 571.116a.

Automotive hydraulic brake fluids used today are most often synthetic glycol-base, water-miscible fluids. Brake fluids suggested in the art to meet the various specification requirements have generally been blends of several components such as lubricants, diluents and one or more oxidation and corrosion inhibitors. Blended hydraulic fluids have contained such lubricants as castor oil, polyoxyalkylene glycols, glycol ricinoleate, and glyceryl ethers of polyoxyalkylene glycols and such diluents as butyl alcohols, amyl alcohols, glycol esters, polyoxyalkylene glycols, ethylene glycol monoalkyl ethers and the like. These blends have not been entirely satisfactory in many instances. Those that are satisfactory with respect to all the requirements are difficult to prepare since a blend component that satisfies one requirement may be deleterious with respect to another requirement. Thus, a blend component that meets a high boiling point requirement frequently does not meet the low temperature viscosity requirement or a blend component that satisfies the low temperature viscosity requirement may adversely affect rubber parts used in hydraulic systems, e.g., cause swelling, softening, and the like.

It is also known that with synthetic glycol-base hydraulic fluids presently used, the water content of the fluid continues to increase with time in service. Normally the water content is 3–4 percent by weight on the average. It can however range as high as 5–6 percent for older cars in more humid areas, and can be as high as 9–10 percent in extreme cases. One undesirable effect of water pickup by a glycol-base hydraulic fluid is the marked increase in the low temperature viscosity of the fluid with its attendant adverse effect on braking performance.

SUMMARY OF THE INVENTION

The present invention provides a hydraulic brake fluid having a particularly desirable combination of properties, including low temperature viscosity which is not adversely affected by the presence of water.

Specifically, there is provided a hydraulic fluid consisting essentially of a random equilibrium mixture of triethylene glycol diesters of acetic and propionic acids wherein the molar ratio of acetic groups to propionic groups in the ester composition is from about 40:60 to 50:50.

DETAILED DESCRIPTION OF THE INVENTION

The hydraulic fluid of the present invention consists essentially of a random equilibrium mixture of triethylene glycol esters of acetic and propionic acids.

Random equilibrium mixtures, as used in the present invention, refers to a product obtained either by a redistribution reaction or by a reaction of more than two reactive components wherein the composition of the product is determined by the law of probability. In the present context, random equilibrium mixture of triethylene glycol diesters of acetic and propionic acids can be a product of the redistribution reaction of triethylene glycol acetate-propionate or of triethylene glycol diacetate and triethylene glycol dipropionate or a product of the esterification reaction of triethylene glycol with a mixture of esterifying agents providing both acetyl and propionyl groups.

A redistribution reaction is one wherein a metathetical reaction occurs (exchange of elements or radicals without a change of valency) with a random distribution of exchanging groups. To illustrate the redistribution reaction, when an equimolar mixture of ethyl acetate and methyl butyrate is heated in the presence of a catalyst such as aluminum ethylate, an interchange or redistribution takes place to provide a random equilibrium mixture containing equal amounts of ethyl acetate, methyl butyrate, methyl acetate and ethyl butyrate. Similarly when a mixture of tetraethyllead and tetramethyllead is treated with an appropriate catalyst a redistribution of the methyl and ethyl groups occurs to provide a random equilibrium mixture containing tetraethyllead, tetramethyllead, triethylmonomethyllead, trimethylmonoethyllead and diethyldimethyllead.

The composition of the random equilibrium mixture can also be approached synthetically. Thus, the above-described random equilibrium mixtures of acetates and butyrates can also be prepared by the esterification of an equimolar mixture of methanol and ethanol with an equimolar mixture of acetic and butyric acids. Similarly, the random equilibrium mixture of alkylleads described above can also be prepared by alkylation of a sodium-lead alloy with a mixture of methyl chloride and ethyl chloride. Thus, the random equilibrium mixture of the present invention is independent of the manner by which it is produced.

The random equilibrium mixture of triethylene glycol esters of acetic and propionic acids is distinct from a simple blend or mixture of triethylene glycol diacetate and triethylene glycol dipropionate. Not only is there a difference in composition but also, as demonstrated in the Example, there is a difference in properties. Thus for example, a blend of an equimolar amount of triethylene glycol diacetate and triethylene glycol dipropionate is a mixture containing simply equal amounts of the two materials. On the other hand, a random equilibrium mixture prepared from the above blend, for example by heating in the presence of a catalyst, such as aluminum ethylate, sulfuric acid, toluenesulfonic acid and the like, is a mixture comprising 50 mole percent of a mixed ester, triethylene glycol acetate propionate, and 25 mole percent each of the triethylene glycol diacetate and triethylene glycol dipropionate.

The composition of the random equilibrium mixture of the present invention is given, in mol percent, by the following

| | |
|---|---|
| triethylene glycol diacetate | $= X^2/100$ |
| triethylene glycol acetate propionate | $= 2(X)(100-X)/100$ |
| triethylene glycol dipropionate | $= (100-X)^2/100$ |

where X is the mol percent of acetyl groups in the combined acetyl and propionyl groups of the ester composition. Thus, the nominal composition of a random equilibrium mixture of triethylene glycol diesters of acetic and propionic acids wherein the molar ratio of acetyl to propionyl groups is 40:60 (i.e. mol percent acetyl is 40) is 16 mol percent triethylene glycol diacetate, 48 mol percent of triethylene glycol acetate propionate and 36 mol percent of triethylene glycol dipropionate. When the molar ratio of acids is 50:50 (i.e., 50 mol percent acetyl), the random equilibrium mixture contains 25 mol percent of the diacetate, 50 mol percent of the mixed ester and 25 mol percent of the dipropionate.

As mentioned, the random equilibrium mixture of the present invention can be prepared by heating an appropriate mixture of triethylene glycol diacetate and triethylene glycol dipropionate in the presence of a catalyst. It is preferred that the random equilibrium mixture of the present invention be prepared by the esterification of triethylene glycol with an esterifying agent providing acetyl and propionyl groups in the desired proportions, e.g., an appropriate mixture of acetic and propionic acids. Any of the usual esterification processes can be used including ester interchange. Commercially available technical triethylene glycol $HO(CH_2CH_2O)_3H$, is suitably used. Thus triethylene glycol is heated (usually at a temperature in the range of about 100°C. to 200°C., preferably about 120°C. to 175°C.) with a mixture of acetic and propionic acids wherein the molar ratio of acetic acid to propionic acid is from about 40:60 to 50:50 in the presence of an acidic catalyst such as hydrochloric acid, sulfuric acid, phosphoric acid and toluene sulfonic acid, and the water of condensation is removed. Usually a slight excess, about 5–10 percent, of acids over that needed to completely esterify the glycol is used. While not necessary, a solvent or a mixture of solvents can be used. When a solvent is used it is additionally desirable that the solvent form an azeotrope with water so that the water of condensation can be removed continuously and the solvent can be recycled continuously to the reaction mixture. Suitable solvents which form azeotropes with water include hydrocarbon solvents such as benzene, toluene, the xylenes and the like. Esterification is considered to be complete when no further amount of water is evolved. The acidic catalyst may be neutralized by the addition of basic material such as sodium carbonate, sodium bicarbonate, calcium oxide, barium oxide and the like. The esterification product can be clarified by filtration, if desired. Depending upon the reaction conditions such as time and temperature, the reaction product may contain some half esters of triethylene glycol, i.e., triethylene glycol monoacetate and triethylene glycol monopropionate. The presence of a small amount of half esters of up to 20% by weight is permissible.

In the random equilibrium mixtures of this invention it is desirable that the molar ratio of acetic to propionic groups be at least 40:60, so that the low temperature viscosity of the random equilibrium mixture is not excessive, and not more than 50:50, so that the effect of the mixture upon rubber will be within acceptable limits.

As is conventional for hydraulic fluids, small amounts (0.1 to 2% by weight) of alkaline inhibitors for pH control, corrosion inhibitors and antioxidants can be present to further improve the characteristics of the present compositions. Inhibitors for the control of pH include alkali metal borates such as sodium borate and potassium tetraborate, alkali metal salts of higher fatty acids such as potassium oleate and sodium stearate, amines such as morpholine, ethanolamine, triethanolamine and dibutylamine, amine salts such as mono- and dibutyl ammonium borate and dibutylamine phosphate. Corrosion inhibitors which can be used include zinc dialkyldithiophosphates, benzotriazole, mercaptobenzotriazole, and triphenyl phosphite. Representative antioxidants include phenothiazine, phenyl-$\alpha$-naphthylamine, phenyl-$\beta$-naphthylamine, diphenylamine, dioctyldiphenylamine, bisphenol A, and hindered phenols such as dibutylated cresol, butylated bisphenol A and butylated hydroxyanisole.

While the present composition can be used as a single liquid component of hydraulic brake fluids, if desired, the composition can be blended with other components such as lubricants and diluents for certain purposes. Such lubricants and diluents include castor oil, polyoxyalkylene glycols, glycerylethers of polyoxyalkylene glycol, polyoxyalkylene glycol monoalkylethers, such as triethylene glycol monomethylether.

The present invention is further illustrated by the following Example.

EXAMPLE 1

A random equilibrium mixture of triethylene glycol esters of acetic and propionic acids was prepared in which the molar ratio of acetyl to propionyl groups was 43:57.

In a reaction flask equipped with a reflux condenser, a Dean-Stark trap and a thermometer were placed 1504 g. of technical triethylene glycol, 541 g. of glacial acetic acid, 840 g. of propionic acid, 0.92 g. of concentrated sulfuric acid and 100 ml of benzene. The mixture was refluxed over the temperature range 120°–200°C. for 2.5 hours, recovering 427 ml of distillate (bottom layer in Dean-Stark trap). The reaction mixture was allowed to cool. The reaction flask was then equipped with a distillation head and the mixture was stripped under a pressure of 12 mm until the vapor temperature reached 60°C. Calcium oxide (5 g.) was added to the reaction mixture and the vacuum stripping continued at 10 mm. pressure until the vapor temperature reached 85°C. The reaction mixture was filtered to yield 2330 g. of the product having a saponification number of 394, an acid number of 0.85 and a hydroxyl content of 1.6 percent.

The random equilibrium mixture obtained was identified as the expected random diester mixture and was tested as a hydraulic brake fluid according to Department of Transportation, Federal Motor Vehicle Safety Standard (FMVSS) 571.116a as described in Federal Register Volume 36, No. 232, Dec. 2, 1971, page 22929 et seq. The test procedures employed were those described therein. Results obtained with the more critical tests are shown in Table I.

The present random equilibrium mixture was compared to a simple two-component blend of 43 mol percent triethylene glycol diacetate and 57 mol percent triethylene glycol dipropionate. The test results for this control blend are also included in the Table.

TABLE I

TESTS FOR CONFORMANCE WITH FEDERAL MOTOR VEHICLE SAFETY STANDARD 116a FOR MOTOR VEHICLE BRAKE FLUID

| | FMVSS 116a Requirement | Control Blend | Example 1 |
|---|---|---|---|
| Equilibrium Reflux Boiling Point, °F | | | |
| Original | 401 min. for DOT3<br>446 min. for DOT4 | 544 | 554 |
| Wet | 284 min. for DOT3<br>311 min. for DOT4 | 360 | 370 |
| Viscosity, cSt | | | |
| 210°F | 1.5 min. | 1.54 | 1.61 |
| −40°F | 1500 max. DOT3<br>1800 max. DOT4 | 838 | 1231 |
| Water Tolerance<br>−40°F | | | |
| Discernibility of black contrast line | Clearly discernible | fail | pass |
| Stratification or Sedimentation | none | none | none |
| Time for bubble to travel to top | 10 sec. max. | — | 2 |
| 140°F | | | |
| Stratification | none | none | none |
| Sedimentation | 0.15% max. | none | none |
| Effect on rubber<br>158°F | | | |
| Hardness Increase | none | none | none |
| Hardness Decrease | 10 IRHD max. | 6 | 3 |
| Base Diameter Increase, in. | 0.006–0.055 | 0.036 | 0.027 |
| Disintegration (stickiness, blister or sloughing) | none | none | none |
| 248°F | | | |
| Hardness Increase | none | none | none |
| Hardness Decrease | 15 IRHD max. | 15 | 8 |
| Base Diameter Increase, in. | 0.006–0.055 | fail (0.063) | 0.039 |
| Disintegration | none | none | none |

The above data in the more critical tests show that the random equilibrium mixture of the present invention qualifies as a brake fluid. Moreover, when compounded to contain a typical alkaline pH control agent, corrosion inhibitor and antioxidant, the present composition passed all the tests in the above specification.

By contrast, the control blend of triethylene glycol diacetate and triethylene glycol dipropionate, having an identical acetyl to propionyl group ratio as the invention composition, failed with respect to the water tolerance test at −40°F. and with respect to the effect on rubber at 248°F.

The composition of this Example tested for low temperature viscosity in the presence of water, since it is known that conventional glycol-base hydraulic brake fluids increase markedly in their low temperature viscosity in the presence of a few percent of water and that such increase in viscosity can adversely affect vehicle braking performance.

The following Table II summarizes the −40°C. viscosities of the present invention composition in the presence of up to 6% by weight of water.

TABLE II

EFFECT OF WATER ON −40°C. VISCOSITIES

| Water (% by wt.) | 0 | 1 | 2 | 4 | 6 |
|---|---|---|---|---|---|
| −40°C. Viscosity of Brake Fluid, Centistokes | 1231 | 991 | 991 | 1032 | 1032 |

The above data show that the low temperature viscosity of the composition not only does not increase but actually decreases in the presence of up to 6% by weight of water.

What is claimed is:

1. A hydraulic fluid consisting essentially of a random equilibrium mixture of triethylene glycol diesters of acetic acid and propionic acid wherein the molar ratio of acetyl groups to propionyl groups in the diester mixture is from about 40:60 to about 50:50.

2. The hydraulic fluid of claim 1 wherein the molar ratio of acetyl groups to propionyl groups is about 43:57.

3. The hydraulic fluid of claim 1 additionally containing effective amounts of at least one of an alkaline inhibitor for pH control, a corrosion inhibitor, an antioxidant, and a lubricant.

4. The hydraulic fluid of claim 3 wherein the diester mixture is about 16–25 mole percent triethylene glycol diacetate, about 48–50 mole percent triethylene glycol acetate propionate and about 36–25 mole percent triethylene glycol dipropionate.

5. A process for preparing a hydraulic fluid, the process comprising reacting triethylene glycol and a mixture of acetic acid and propionic acid in the presence of an acid catalyst and removing the water of condensation, the amount of acid mixture used being in the range of the stoichiometric amount needed to completely esterify the glycol to a 10 percent excess of that amount, and the molar ratio of acetic acid to propionic acid being from about 40:60 to about 50:50.

6. The process of claim 5 wherein the reaction is conducted at a temperature in the range of about 100°C to 200°C.

7. The process of claim 5 wherein the acid catalyst is hydrochloric acid, sulfuric acid, phosphoric acid or toluenesulfonic acid.

* * * * *